US005178292A

United States Patent [19]

Korzeniowski

[11] Patent Number: 5,178,292

[45] Date of Patent: Jan. 12, 1993

[54] REINFORCED PLASTIC INTERMODAL FREIGHT CONTAINER CONSTRUCTION

[75] Inventor: George Korzeniowski, Salt Lake City, Utah

[73] Assignee: Aluminum Company of America, Pittsburgh, Pa.

[21] Appl. No.: 695,542

[22] Filed: May 3, 1991

[51] Int. Cl.[5] ..... B65D 88/14

[52] U.S. Cl. ..... 220/1.5; 220/668; 220/652

[58] Field of Search ..... 220/1.5, 668, 643, 652, 220/651, 682, 692

[56] References Cited

U.S. PATENT DOCUMENTS

| | | | |
|---|---|---|---|
| 3,276,832 | 10/1966 | Reilly | 220/668 |
| 4,288,136 | 9/1981 | Le Mer | 220/668 |
| 4,416,384 | 11/1983 | Bjurling | 220/1.5 |
| 4,428,491 | 1/1984 | Mittelmann et al. | 220/668 |
| 4,505,402 | 3/1985 | Gerhard | 220/1.5 |
| 4,614,278 | 9/1986 | Gerhard | 220/1.5 |
| 4,872,574 | 10/1989 | Lam | 220/668 |
| 4,905,822 | 3/1990 | Bosco | 220/668 |
| 4,998,636 | 3/1991 | Hardigg | 220/668 |
| 5,052,579 | 10/1991 | Boots | 220/668 |

*Primary Examiner*—Joseph Man-fu Moy

*Attorney, Agent, or Firm*—Robert J. Schaap; Gary P. Topolosky

[57] ABSTRACT

A freight container made of plastic composite material comprised of (1) an outer skin including a roof, floor and side walls and (2) a main frame structure. The frame structure includes longitudinally extending upper beams and lower beams which extend for the full length of the container. Upright beams connect the upper and lower longitudinal beams at selected locations. The container is also provided with connector regions for connecting two or more intermodal containers in a stacked arrangement and for being engaged by a crane to raise and lower the container. The connector regions are located at intersections of the upper and lower longitudinal beams respectively with certain of the upright beams. The main longitudinal beams are of a tubular construction. Metal reinforcing members are located at each of the upper connector regions and these connectors are effectively incorporated in the hollow beams. Metal lock receiving members are disposed within the upper beams and secured to the reinforcing members. The design is unique in that the metal reinforcing members are effectively integrated into the reinforced plastic composite material construction.

18 Claims, 2 Drawing Sheets

REINFORCED PLASTIC INTERMODAL FREIGHT CONTAINER CONSTRUCTION

BACKGROUND OF THE INVENTION

1. Field of the Invention

This invention relates in general to certain new and useful improvements in an intermodal freight container construction, and more particularly, freight container structures which are primarily formed of reinforced plastic composite materials and reinforced by metal structural members at connector regions and where the metal structural members are integrated with the composite members.

2. Brief Description of the Prior Art

Intermodal transport containers for the shipping of freight are well known and have been widely used for a substantial period of time. These intermodal containers are highly effective where the cargo is designed for intercontinental shipment. Products of more sophisticated technology such as automobiles, television sets, etc., are frequently made in certain countries and transported to markets in other countries which do not have the technology or facilities to produce same.

Products for intercountry shipment are usually loaded into an intermodal freight container at a site of manufacture and shipped to a seaport by rail transportation. The intermodal freight container is thereafter loaded into an ocean-going ship for transport between continents. Upon arrival at the destination continent, the intermodal freight container is then removed from the ship and loaded onto a railroad transport car for delivery to a particular city where the container can then be loaded onto a truck transport for delivery to a particular site of use.

Very recently, there have been several proposals to provide intermodal vehicle haulers for the transport of automobiles. However, these proposed intermodal vehicle haulers were all to be primarily formed of metals such as aluminum or steel or combinations thereof. There have also been several vehicle haulers employed by railroad companies for the transport of vehicles but these vehicle haulers are all constructed from aluminum and steel combinations.

There are numerous problems which arise in the shipping of automobiles or other freight which is environmentally sensitive and subject to environmental damage in metal containers. Accordingly, there has been a need for a container which is made of non-metal materials as for example, a reinforced plastic composite material The prior art is replete with metal containers having connector regions for removable connection to both freight container transports, such as flat bed trucks and flat bed railroad cars, and to other intermodal freight containers. Exemplary of these freight containers are those described and illustrated in U.S. Pat. No. 4,819,280 dated Apr. 11, 1989 to Weiner. This Weiner Patent discloses a lockable cargo container having elongate beams with connectors at the ends of the containers. The entire structure of the Weiner Patent is made of a metal, presumably aluminum and other metal combinations.

U.S. Pat. No. 3,456,829, dated Jul. 22, 1969 to Glassmeyer also discloses a container frame structure including a longitudinal metal beam and corner locking portions for intermodal container stacking. However, and again, the Glassmeyer frame structure is entirely formed of metal materials. U.S. Pat. No. 4,341,495 to Del'Acqua also discloses corner stackable containers having lockable corner posts. A locking member is capable of being received at each of these corner posts.

U.S. Pat. No. 3,801,177, dated Apr. 2, 1974 to Fylling et al also discloses reinforcing V-shaped torsion box beams. Fylling et al describe their shipping container as being frameless, although the container nevertheless includes several beams such as torsion beams which support articles in tiers and also distribute loading forces. U.S. Pat. No. 3,815,517, dated Jun. 11, 1974 to Przybylinski discloses a structure similar to that in the Fylling et al patent. However, the container in the Przybylinski Patent is designed for the transporting of automobiles. Przybylinski does employ longitudinally extending braces.

Each of the prior art intermodal containers heretofore described were all essentially constructed of metal. There have also been several proposed intermodal vehicle haulers for the transporting of automobiles but again, all such proposed haulers are to be formed of metals as aforesaid. This presents numerous problems, such as corrosion problems, unsealed interiors, substantial weight, and the like.

One of the major considerations in producing reinforced plastic composite intermodal freight containers is the fact that they must be light in weight, and preferably lighter in weight than a corresponding metal freight container. Furthermore, they must be capable of being environmentally sealed so as to protect the contents from salt water spray during ocean transit and from other environmental contaminants which can enter the container and possibly damage the contents.

It is also desirable to provide a connector system which permits interlocking of stacked intermodal freight containers without a gap between two stacked intermodal containers and which would improve the load distribution efficiency and reduce the overall height. Further, it would be desirable to have an intermodal freight container constructed substantially of reinforced plastic composite materials and which is light in weight but which has sufficient strength to withstand compressive and bending loads imposed on the container.

OBJECTS OF THE INVENTION

It is, therefore, one of the primary objects of the present invention to provide an intermodal freight container constructed primarily from a reinforced plastic composite frame and composite walls and floor and roof with metal reinforcing at selected connector regions.

It is another object of the present invention to provide a frame structure for use with reinforced plastic composite intermodal freight containers of the type stated and which integrates metal reinforcing members with the composite frame members at the connector regions.

It is also an object of the present invention to provide a frame structure for composite containers of the type stated which may have a relatively thin-walled skin and which employs metal reinforcing members at selected connector regions in order to enable the stacking of containers and the loading and unloading of the containers from a transport by use of a crane.

It is a further object of the present invention to provide a frame structure of the type stated which is relatively light in weight but which is capable of assuming substantial bending and compressive loads.

It is still another object of the present invention to provide a connector system for reinforced plastic composite containers which utilizes a reinforced plastic beam arrangement along with metal inserts for reinforcing at selected connector regions.

With the above and other objects in view, my invention resides in the novel features of form, construction, arrangement and combination of parts presently described and pointed out in the claims.

BRIEF SUMMARY OF THE INVENTION

An intermodal freight container of the type which is generally, although not necessarily, rectangular in shape and comprises a roof and a floor connected by sidewalls and end walls. Doors may be mounted in or employed in place of the end walls for access to the interior thereof. The intermodal freight container is constructed substantially of reinforced plastic composite material and in a preferred embodiment, the roof, floor and side wall as well as any end walls, are constructed almost entirely of reinforced plastic composite material.

The container includes a frame structure which is uniquely designed to receive and distribute the loads imposed on the intermodal transport container, particularly when the container is formed of relatively thin outer walls, roof and floor for purposes of reducing the overall weight and for minimizing fabrication costs. The frame structure comprises a space frame including a pair of upper longitudinally extending beams and a pair of lower longitudinally extending beams. The upper beams are connected by cross-beams and the lower beams are connected by cross-beams. Further, the upper and lower sets of beams are connected by generally vertical upright beams. The upright beams form part of or may be secured to the sidewall forming part of the intermodal freight container.

One of the important aspects of the present invention is the fact that the main longitudinally extending beams and particularly the upper longitudinally extending beams are located at corner portions between the roof and the side walls. These longitudinally extending beams are hollow in construction and they are somewhat triangularly shaped in cross-section. Intersections of certain of the generally upright beams and the longitudinally extending upper frame beams constitute connector regions.

A metal reinforcing member is located within the upper beams at each of these connector regions. The metal reinforcing members extend for a portion of the length of the upper beams in and on both sides of these connector regions. Furthermore, the metal reinforcing members at these connector regions are essentially and substantially enclosed within the composite beam. In this way, any exposure of the metal components to the inside of the intermodal freight container is minimized.

A connector receiving member is also located within the metal reinforcing member. The connector receiving member is designed to receive a conventional connector or so-called lock of the type used in intermodal freight containers. The connector member or lock is designed to extend between the roof of one composite container and the floor of the next composite container so as to enable stacking of the containers in a secured relationship. Furthermore, the connector regions also serve as points for connection to a crane so that the crane may lift the intermodal freight container for movement to a different location.

The connector system of the invention permits an interlocking of an upper container with a container therebeneath without any gap between the floor and the roof of the two containers. Not only does this improve load distribution, but it also reduces the overall height of the stacked containers.

In a conventional interlocking system of the type used in the prior art intermodal freight containers, the pair of stacked containers only effectively had contact at the connector points with a gap existing between the roof of the lower container and the floor of the upper container. This gives rise to vibration, and also there is generally a fatigue and overstressing of the components of the containers.

In the frame system of the present invention, the connector receiving members extend up to and are flush with the surface of the roof. In like manner, the connector receiving members at the lower longitudinally extending beams also extend to the lower surface of the floor and are flush with the lower surface of the floor. This enables the container of the present invention to be stacked without any gap between the containers.

One of the important aspects of the present invention is the fact that the intermodal container of this invention can be constructed almost entirely of reinforced plastic composite materials. The metal inserts in the upper longitudinally extending beam are effective for distributing loads imposed on the container, either compression loads from the other containers stacked thereon or tension loads when lifted by a crane at the upper connector regions.

The container construction of this invention places the metal reinforcing members within the hollow upper longitudinally extending frame beams. In addition, the connector receiving members are located within the respective metal reinforcing members. This, in effect, provides a structural integration of the metal and the composite parts into the container design This also enables the transfer and handling of substantially all dynamic and static loads of stacked containers. All of the composite parts in the high load concentration areas are effectively reinforced with the steel members. This traps the composite member from both sides and distributes loads to the prime composite structural members, such as the longitudinally extending beams and the generally upright beams.

The connector receiving member is flat at its upper surface and further the upper surface of this receiving member is flush with the roof of the container. However, there is an opening in the roof in order to enable a connector to extend into the connector receiving member in the upper longitudinally extending beam. The connector receiving member is cup-shaped and therefore, any water which might be located on the roof of the container is allowed to drain into the connector receiving member where it is then drained directly to the exterior of the container. In this way, there is no water collection in the interior of the container.

The reinforced plastic composite upper longitudinal beam has a shape which is generally triangular in cross-section and, as such, is designed as a prime structural member. The upper beams are each formed by portions of the roof and a side wall and a strut extending between the roof and the associated side wall. Thus, the beams are triangular in cross-section and form an envelope to receive the metal components. The shape of this upper beam integrates the female upper metal reinforcing member within the composite materials including the side wall and the roof within a minimum envelope. Further, a steel cover located on the exterior surface of the roof provides a bearing surface for connecting bolt heads and nuts. It also protects the composite material roof from damage by locks on other containers.

This invention possesses many other advantages and has other purposes which may be made more clearly apparent from a consideration of the forms in which it may be embodied. Some embodiments of the invention will now be described in detail for purposes of illustrating the general principles of the invention, but it is to be understood that such detailed description is not to be taken in a limiting sense.

BRIEF DESCRIPTION OF THE DRAWINGS

Figure 1:
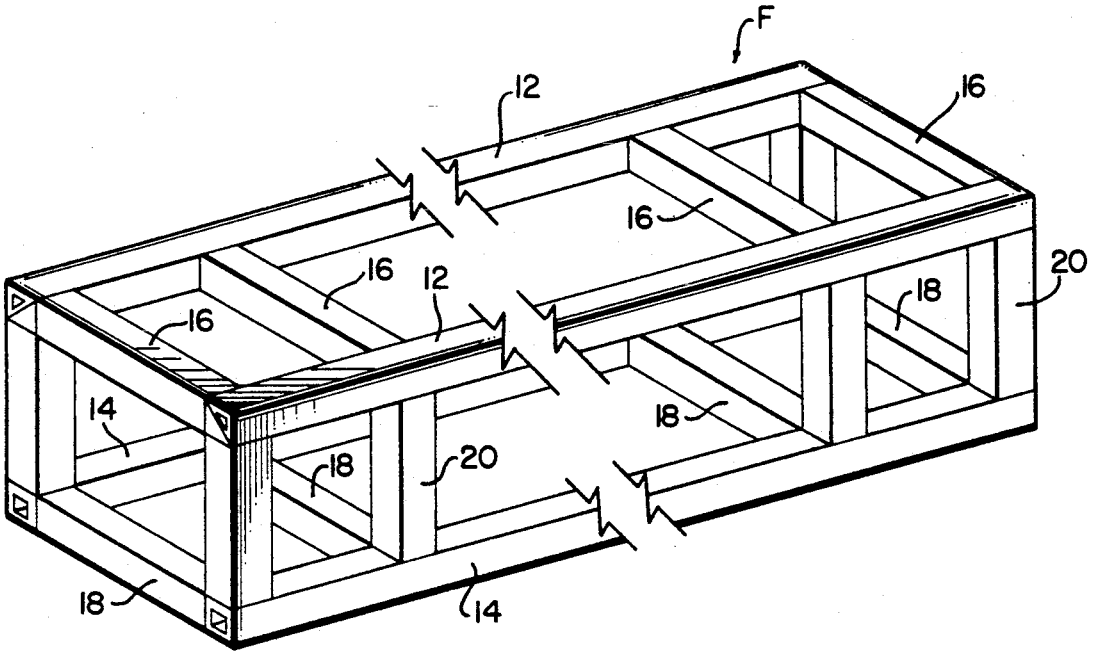
Figure 4:
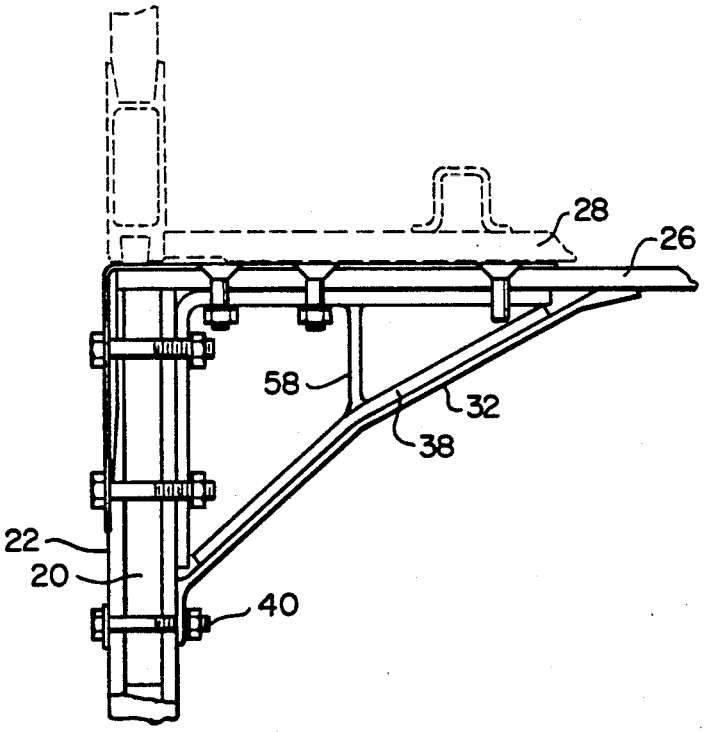
Figure 2:
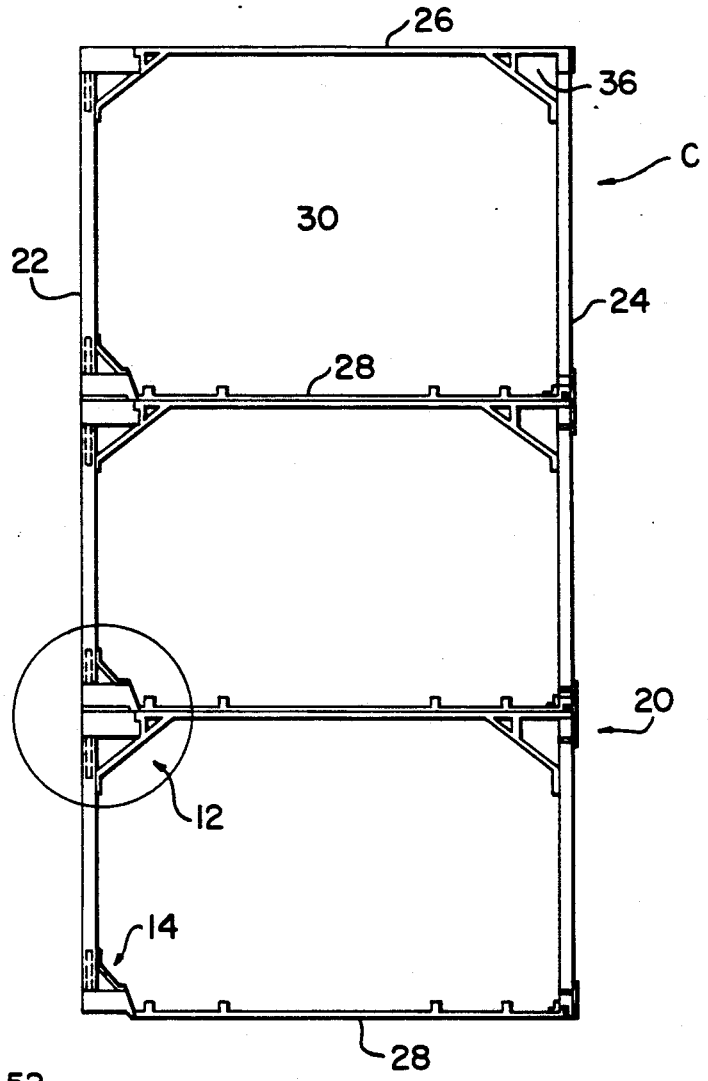
Figure 3:
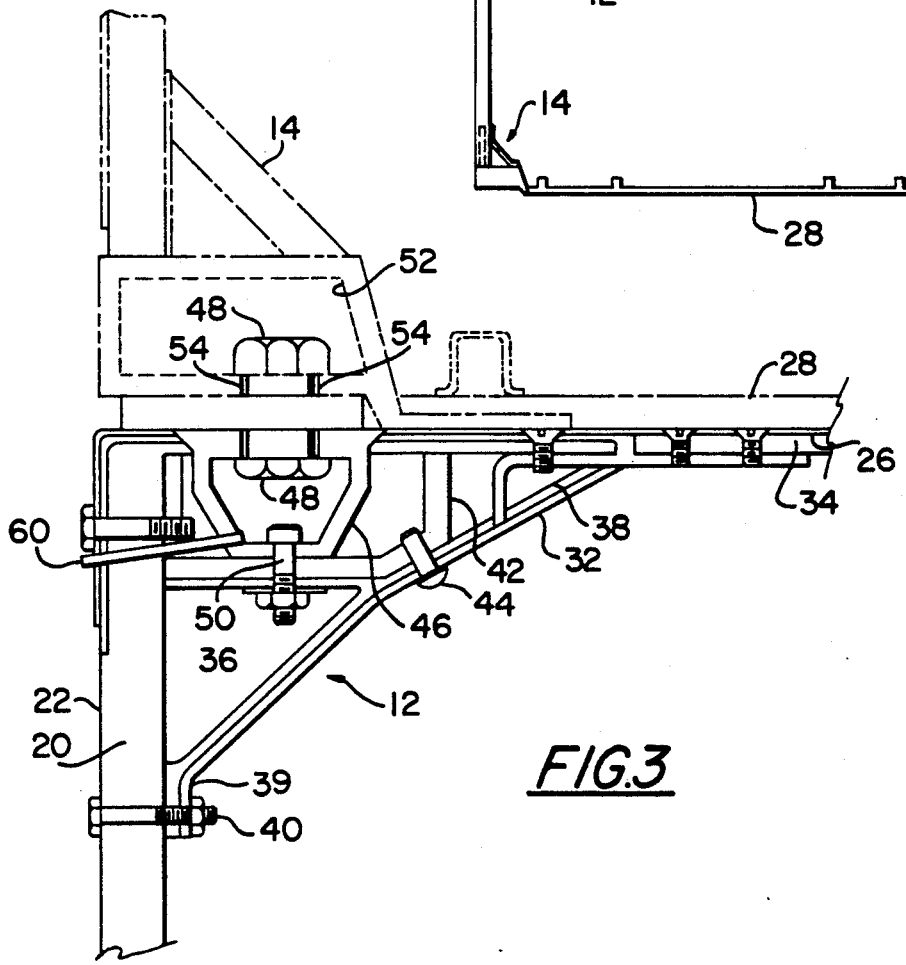

Having thus described the invention, in general terms, reference will now be made to the accompanying drawings in which:

FIG. 1 is a perspective view of a reinforced plastic composite intermodal freight container constructed in accordance with and embodying the present invention;

FIG. 2 is an end elevational view, with end walls removed, of three vertically stacked intermodal freight containers of the invention;

FIG. 3 is an enlarged fragmentary sectional view taken substantially along line 3—3 of FIG. 2; and FIG. 4 is a vertical sectional view, somewhat similar to FIG. 3, and showing the upper beam construction at a corner portion of an intermodal container.

DETAILED DESCRIPTION OF PREFERRED EMBODIMENTS

Referring now in more detail and by reference characters to the drawings, C designates a reinforced plastic composite intermodal freight container The freight container C generally comprises two major structural sub-systems which include (1) a space frame and particularly a unique space frame structure F made in accordance with this invention and (2) a large number of reinforced plastic composite skins in the form of walls, a roof and a floor which extend around the frame. In a preferred embodiment, the walls, roof and floor may be comprised of endwise connected panels which are preferably rib-reinforced.

Turning now to FIG. 2, it can be observed that each container C of the invention is comprised of a pair of side walls 22 and 24 connected by a roof or top wall 26 and a floor or bottom wall 28 thereby defining an interior cavity 30. The side walls 22 and 24 may be integrally fabricated with the upright beams 20 as a part thereof or they may be formed as separate skins and secured to the upright beams 20.

FIG. 1 illustrates the frame structure F of the present invention. In this case, the frame structure F includes two upper longitudinally extending reinforced plastic frame beams 12. These beams 12 are of a triangularly shaped hollow construction, as illustrated in FIGS. 1 and 3 of the drawings. The main frame F also includes a pair of lower longitudinally extending beams 14 which are also of a hollow construction However, the beams 14 are generally rectangular in shape. By reference to FIG. 2, it can be observed that the four beams 12 and 14 are located in a rectangular arrangement.

Extending between the upper longitudinally extending beams 12 are upper cross-beams 16 and similarly extending between the lower longitudinally extending beams 14 are lower cross-beams 18. Finally, connecting the upper and lower portions of the frame are vertically arranged beams 20 on each of the opposite sides of the frame. By further reference to FIG. 1, it can be observed that four of the vertically arranged beams are located on each of the opposed longitudinal sides of the intermodal freight container. The interior vertically arranged beams 20 also define reinforced connector regions where they interset the upper and lower longitudinal beams 12 and 14, respectively, as hereinafter described in more detail.

The reinforced plastic composite panels are then secured to the structural frame. These panels which form the walls, the roof and the floor of the container are actually reinforced plastic composite skins, but to some extent, also serve to distribute the load throughout the container. For this reason, the walls and the roof and the floor are preferably ribreinforced.

The frame structure of the present invention includes the upper longitudinally extending frame beams 12 as aforesaid. By reference to FIG. 3, it can be observed that each frame beam 12 is actually comprised of a reinforced plastic composite strut 32 which is secured to the roof 26 and to a vertically arranged side wall beam 20 or a side wall 22 or 24. Therefore, this strut 32 along with a portion of a side wall 22 and the roof 26 forms a somewhat triangularly shaped envelope 36. Moreover, each upper beam 12 extends for the full length of the intermodal container.

A metal brace 38 also extends between the roof and the roof, and particularly a side wall beam 34, that is, a rib on the underside of the roof 26, and the side wall 22. The metal brace 38 is located so as to be in intimate contact with the reinforced plastic composite strut 32, as best illustrated in FIG. 3 of the drawings. Finally, the combination of the struts 32 and 38 are secured to the roof beam 34 and have flange portions 39 which are secured to the generally upright beam 20 or side wall 22 by means of bolts 40.

A conventional intermodal freight container is provided with connector receiving members at specified locations. These locations are standard with all intermediate freight containers so that one intermodal freight container can be stacked with and secured to another intermodal freight container. Further, the standard spacing of the connector regions allows for the freight containers to be connected to conventional transports such as a railroad car transport or a truck transport. The frame structure F of the present invention utilizes a connector arrangement corresponding to the conventional standard connector arrangement. In this case, a generally upright beam such as the side wall beam 22 is located at each connector region.

In each connector region, a metal insert 42 is provided. This insert adopts the form of a somewhat of L-shaped bracket and is secured to the struts 32 and 38 by means of a screw 44. These metal reinforcing members 42 do not extend for the entire length of the beam 12. However, they extend for a distance of approximately seven feet, that is, about 3½ feet on each side of each connector region so as to adequately distribute loads throughout the main horizontally extending upper beams 12 and the generally upright beams 20. The metal reinforcing members 42 primarily serve to reinforce the connector regions.

In each of the upper connector regions, a metal lock receiving bracket or so-called "cup" 46 is secured to and supported by the reinforcing insert 42 located within a longitudinally extending beam 12. In this case, the cup 46 is designed to receive a lock mechanism 48 of a conventional type used in conventional intermodal transport containers. The cup 44 is suitably secured to the longitudinally extending metal insert 42 by means of bolts 50, as best illustrated in FIG. 3 of the drawings.

The lower beams 14 also include hollow metal reinforcing inserts 52 and are sized to receive one portion of the lock mechanism 48. In this way, vertically stacked containers may be secured to one another by means of this lock mechanism 48, often referred to as a "connector". Each such lock mechanism 48 has a shank which extends through aligned apertures 54 in the cup 46 and the reinforcing insert 42 in the upper beam 12 and in the metal insert 52 in the next upper container.

FIG. 4 illustrates the frame construction at a corner portion of an intermodal freight container. This arrangement is employed where connector regions are not located at the corner between the upper roof and a sidewall and one of the transverse ends of the container. In this case, the construction is similar to that previously used at a connector region, except that the metal insert 42 and the metal cup 46 are not employed at the nonconnector regions. Rather, a vertically extending strut 58 is secured to and extends between the roof beam 34 and the metal strut 38.

It can be observed that the connector receiving members, namely the cups 46 each have an upper surface which is flush with the roof surface. In like manner, the metal reinforcing members 52 in the lower beams also have openings which are flush with the lower surface of the intermodal freight container. In this way, there is afforded an interlocking of an upper container and a lower container without any gap whatsoever between the floor and the roof of these two containers. By definition, this greatly improves load distribution from one container to the next lower container. It can also be observed that the upper longitudinal connector assemblies serve to integrate the metal and composite parts of the frame structure into a reinforced plastic composite container. This will enable handling of substantial dynamic and static loads. In effect, all composite parts are in the load concentration areas reinforced with steel and further, they become integral with the composite assembly to distribute the loads to the prime structural members.

It can be observed that there is no portion of any connector member 48 which extends outside of the body of a reinforced composite container. Moreover, no portion of any connector member extends beyond the upper beams 12 and the lower beams 14. Furthermore, since the connector regions are located at a corner between a roof and a side wall, maximum strength is provided. In addition, it can be observed that there is no need for bonding the metal components to the reinforced plastic composite components. As a simple example, the metal strut 38 essentially conforms to the shape of the reinforced composite strut 32 and further, both are designed to rigidly attach to the metal reinforcing insert 42.

The connector receiving cup 46 is also provided with a drain pipe 60 permitting any water which collects in the cup to drain to the exterior of the intermodal transport container.

Thus there has been illustrated and described a unique and novel intermodal freight container constructed primarily of a reinforced plastic composite material with metal reinforced connector regions enabling flush stacking of freight containers. The present invention therefore fulfills the objects and advantages which have been sought. It should be understood that many changes, modifications, variations and other uses and applications will become apparent to those skilled in the art after considering this specification and the accompanying drawings. Therefore, any and all such changes, modifications, variations and other uses and applications which do not depart from the spirit and scope of the invention are deemed to be covered by the invention

Having thus described the invention, what I desire to claim and secure by letters patent is:

1. An intermodal freight container construction comprising:

a) a roof formed of a reinforced plastic composite material, b) a side wall connected to said roof at its upper end, said side wall being formed of a reinforced plastic composite material, and c) a reinforced plastic composite brace extending between and secured to said roof and said side wall and forming a somewhat triangularly shaped main upper composite frame beam in said container.

2. The intermodal freight container construction of claim 1 further characterized in that a metal reinforcing member is located in an envelope area between the side wall and roof and the reinforcing member is secured to at least said brace.

3. The intermodal freight container construction of claim 2 further characterized in that said metal reinforcing member is somewhat L-shaped and located in interior envelope area formed by said roof and side wall, and a connector receiving member is located within said interior compartment.

4. The intermodal freight container construction of claim 3 further characterized in that said metal reinforcing member forms a chamber with said roof and side wall and a lock receiving member is located within the chamber formed by the side wall, roof and reinforcing member.

5. The intermodal freight container construction of claim 4 further characterized in that said lock receiving member extends to the roof and the roof is provided with an opening to enable access to said lock receiving member.

6. The intermodal freight container construction of claim 2 further characterized in that a metal plate is secured to an exterior surface of said roof.

7. An intermodal freight container construction comprising:

a) a roof formed of a reinforced plastic composite material, b) a side wall connected to said roof at its upper end, said side wall being formed of a reinforced plastic composite material, c) means forming a reinforced plastic composite hollow beam with said roof and side wall and which composite beam extends longitudinally within said container, and d) a metal strut located within the beam and extending between and secured to the side wall and the roof for transferring compression loads on the upper end of said container through the side wall.

8. The intermodal freight container construction of claim 7 further characterized in that the means forming the beam is a composite strut which extends between the roof and side wall, and said metal strut extends along said composite strut in contact therewith and is located within the envelope area formed by the side wall, roof and composite strut.

9. A frame structure for a light weight reinforced plastic composite intermodal freight container where exposure of metal containing components to the interior of the container is minimized, said frame structure comprising:

a) a plurality of reinforced plastic composite hollow longitudinally extending upper frame beams, b) a plurality of reinforced plastic composite hollow longitudinally extending lower frame beams, c) a plurality of additional reinforced plastic composite beams connecting the upper beams and the lower beams, and d) a metal reinforcing member located within said upper and lower beams at a plurality of selected connector regions, said metal reinforcing members being substantially enclosed within at least said upper composite beams so a to minimize metal exposure to the interior of a freight container.

10. The frame structure of claim 9 further characterized in that said additional beams include cross beams connecting the upper beams and cross beams connecting the lower beams and upright beams connecting the upper and lower beams.

11. The frame structure of claim 10 further characterized in that said metal reinforcing members are located within said upper beams and said lower beams at the region where the upright beams connect to the upper beams and the lower beams.

12. The frame structure of claim 11 further characterized in that said metal reinforcing members are located in connector regions for connecting the container to a transport or another container.

13. The frame structure of claim 9 further characterized in that a metal brace extends between and is secured to a roof of a container and one of said additional beams and is covered by a wall of one of said longitudinally extending frame beams.

14. A frame structure for a light weight reinforced plastic composite intermodal freight container where the container is strengthened at connector regions with metal containing components, said frame structure comprising:

a) a plurality of reinforced plastic composite upper longitudinally extending frame beams, b) a plurality of connector regions on said upper frame beams, said upper beams being hollow at least at each of said plurality of connector regions, and c) a metal reinforcing member located in each said upper beam at each said connector region and constructed to receive a locking member extending between the composite intermodal container and another intermodal freight container and being substantially enclosed within said composite beam.

15. The frame structure of claim 14 further characterized in that each said reinforcing member has an opened interior section and a metal connector receiving member is located within the opened interior section of each said reinforcing member and is secured thereto.

16. The frame structure of claim 15 further characterized in that a metal brace extends between a side wall and a roof of a container and is secured to said metal reinforcing member, and a reinforced plastic composite brace extends over said metal brace and also extends between the roof and side wall of a container.

17. A connector system for a reinforced plastic composite intermodal freight container having longitudinally extending upper hollow composite beams at corner portions between side walls and a roof of the container, said connector system comprising:

a) a metal reinforcing member located within said composite frame beam and being secured thereto, said reinforcing member extending along a portion of the length of the beam for a distance sufficient to distribute vertical loading through the beam and to a side wall, b) a metal connector receiving member located within said metal reinforcing member, c) means forming an opening in said roof and said connector receiving member located at said opening and extending to but not beyond the surface of said roof, and d) said reinforcing member and connector receiving member being located completely within said composite frame beam.

18. The connector system of claim 17 further characterized in that water draining means is associated with said reinforcing member and said connector receiving member for draining any water entering the connector receiving member to the exterior of the container.

* * * * *